United States Patent [19]

Kirkwood et al.

[11] 4,318,701

[45] Mar. 9, 1982

[54] POWER STEERING SYSTEM FOR BOATS

[76] Inventors: Creal E. Kirkwood, Rte. 1, Box 353C, Wagoner, Okla. 74467; Ted O. Dunagan, P.O. Box 157, Lancaster, Tex. 75146

[21] Appl. No.: 153,597

[22] Filed: May 27, 1980

[51] Int. Cl.[3] ..... B63H 21/26

[52] U.S. Cl. ..... 440/51; 440/62; 440/63

[58] Field of Search ..... 440/51, 53, 62, 63, 440/900, 1; 114/144 R, 162, 163, 167; 244/76 B, 87

[56] References Cited

U.S. PATENT DOCUMENTS

| | | | |
|---|---|---|---|
| 2,993,464 | 7/1961 | Conover | 440/51 |
| 3,149,605 | 9/1964 | Broadwell | 440/51 |
| 3,943,878 | 3/1976 | Kirkwood | 440/51 |

*Primary Examiner*—Sherman D. Basinger
*Attorney, Agent, or Firm*—Head & Johnson

[57] ABSTRACT

A power steering system for outboard motors or inboard/outboard units for boats having a pivoted motor assembly so that by pivotation of the assembly the boat is steered, the system including a control rudder mounted aft of the motor assembly propeller, a steering member which is laterally displaced adjacent the motor assembly to steer the boat, a control rudder steering linkage extending from the control rudder to the steering member so that when the steering member is laterally displaced the control rudder is displaced to apply torque to the motor assembly to rotate it and thereby apply steering force to the motor assembly, a lockable slip between the steering member and the motor assembly which, in the locked condition, the steering member is secured to the motor and in the unlocked condition a preselected amount of slip is provided between the steering member and the motor assembly, apparatus for detecting the speed of the boat forward movement connected to actuate the lockable slip to lock the steering member to the motor assembly when the detected forward speed of the boat is below a preselected rate.

13 Claims, 6 Drawing Figures

POWER STEERING SYSTEM FOR BOATS

BACKGROUND OF THE INVENTION

1. Field of the Invention

The invention is related to apparatus for providing power steering assist to outboard motors and to inboard/outboard motor assemblies employing a control rudder supported in the slip stream and means to lock the steering mechanism directly to the motor assembly when the boat is moving below a preselected rate.

2. Description of the Prior Art

Most boats employ a motor assembly which is pivotally supported to the stern of the boat. These motor assemblies are of two basic types, that is, the outboard type in which the motor and power drive, including the propeller, are all arranged as a unit and, the second type, known as the inboard/outboard type in which the motor is mounted within the boat forward of the stern and a drive shaft extends through the stern to drive an outboard unit which is pivoted so as to apply turning direction to the boat.

In these typical arrangements the boats include a steering mechanism which is usually in the form of a steering wheel, although for some sport fishermen, a steering stick is utilized. Whether employing a steering wheel or a steering stick, a means is provided for positioning a steering member adjacent to the outboard drive assembly. The steering member is usually controlled by the steering wheel by means of cables, a flexible shaft, or a hydraulic system.

The usual means of steering an outboard or inboard/-outboard type motorboat is to connect the steering member directly to the drive assembly. In the case of an outboard motor, the entire outboard motor unit is pivoted to provide steering; and in the case of the inboard/-outboard arrangement, the outboard motor assembly is pivoted to steer the boat. This arrangement works completely satisfactory when the motor is of fairly low horsepower or when operating at high speeds. When high horsepower units are employed, however, the torque of the engine and the propeller is applied to the steering system. This torque is amplified during turning maneuvers, and for this reason, steering can become exceedingly difficult and tiresome on high-powered boats when operating at higher speeds.

In order to assist in steering of larger outboard motors and inboard/outboard boats, a highly improved steering means is accomplished by using a fin located in the propeller slip stream. The fin reacts with the stream of water from the propeller, and when turned at an angle, torque face is applied to the propeller assembly. Reference may be had to U.S. Pat. No. 3,943,879 entitled "Power Steering System for Boats" for an example of the use of an auxiliary fin located in the propeller stream for steering a boat. Other references to the use of auxiliary fins are found in U.S. Pat. Nos. 3,149,605; 2,993,464; 1,166,749, and 1,540,079.

These devices substantially increase the ease and safety of steering higher-powered boats, but each has a limitation. The devices most commonly employ a fin located rearwardly of the propeller and in the propeller slip stream. The boat steering mechanism is arranged so that when steering control is applied it first moves the fin rather than moving the motor assembly itself. The fin then reacts with the flow of water and applies a turning torque to turn the motor assembly. If the fin fails to achieve the required torque necessary to turn the motor, further actuation of the steering mechanism then engages to turn the motor assembly. Thus, in the system there is a slip arrangement between the steering mechanism and the motor permitting the power assist fin to be turned before steering torque is applied to the motor. This system works exceedingly well when used on a boat traveling in the forward direction and at a fast speed. However, when a boat is traveling at a slow speed, the torque applied to the fin is insufficient. Adequate steering of the boat at slow speeds is accomplished only when the motor assembly itself is turned by the steering mechanism. This means that the operator must overcome a large amount of slack in either direction of rotation of the steering wheel before steering force is applied to the motor assembly. Another problem with the auxiliary finned type power assist steering system is in backing the boat. The fin arrangement is not only ineffective as far as assisting steering, but in fact, works contrary to the desired arrangement for providing steering control.

A third problem exists with the auxiliary fin power assist type steering systems which is less common than the first two mentioned difficulties, and that is, on high-speed boats the power assist fins may actually be out of engagement with the water as the boat rides high upon the propeller. Under these conditions the power assist fins are of no value and sloppy steering is achieved.

An object of the present invention is to provide an improved power steering system for outboard motors and/or inboard/outboard power units which overcomes the problems with existing power steering devices.

More particularly, an object of this invention is to provide an improved power steering system for outboard motors or inboard/outboard power units employing auxiliary power assist fans, including means to automatically couple the boat steering system directly to the motor assembly under conditions wherein the auxiliary fins would be of no advantage.

These general objects as well as other and more specific objects of the invention will be fulfilled in the following description and claims, taken in conjunction with the attached drawings.

SUMMARY OF THE INVENTION

A power steering system is provided for outboard motors or inboard/outboard units which includes a motor assembly having a power shaft and gears driving a propeller mounted on a horizontal rearwardly extending shaft. The motor assembly is adapted for rotation about a vertical hinge means which is secured to the stern of the boat. At least one control rudder is mounted on a vertical axis on the motor assembly aft of the propeller and positioned in the slip stream of the propeller so that when the control rudder is at an angle relative to the path of travel of the propeller, steering torque is applied to rotate the motor assembly. The boat includes a steering assembly providing a steering member which is laterally displaced in a horizontal plane adjacent the motor assembly as controlled by the operator to steer the boat. The steering member is forward of the vertical axis of rotation of the motor assembly. A control rudder steering means extends from the control rudder to the steering member so that when the steering member is laterally displaced the control rudder is rotated about its axis whereby the force of the slip stream will apply torque to the motor assembly to rotate the motor assembly and thereby applying steering force to the motor assembly. A lockable slip means is positioned between the steering member and the motor assembly in which, in the locked condition, the steering member is secured to the motor assembly, that is, when the operator turns the boat steering wheel the motor assembly is directly turned irrespective of the position of the control rudder. In the unlocked condition a preselected amount of slip is provided between the steering member and the motor assembly, that is, when the boat steering wheel is rotated the steering member may move a preselected distance, moving the control rudder, before engagement is had with the motor assembly to rotate it. The system includes a means of detecting the speed of the boat forward movement. From the speed detecting means there is provided a means to actuate the lockable slip responsive to the speed detecting means. When the speed detecting means detects a minimum forward speed of the boat, a lockable slip is moved to the unlocked condition, that is, where steering motion first moves the control rudder before applying torque to rotate the motor assembly. In the locked condition, which exists when the speed of movement of the boat is below a preselected level or when the boat is moving in the rearward direction, the steering member is connected directly to the motor assembly and steering motion is applied directly to rotate the motor without slippage. In this manner, the power steering achieved by the control rudder is utilized when the boat is moving in a forward direction above a preselected speed. In one embodiment, employing a pitot tube, the steering member is locked directly to the motor assembly even if the boat is traveling at a high rate of speed in the forward direction if the control rudder is out of the water.

DESCRIPTION OF THE VIEWS

Figure 4:
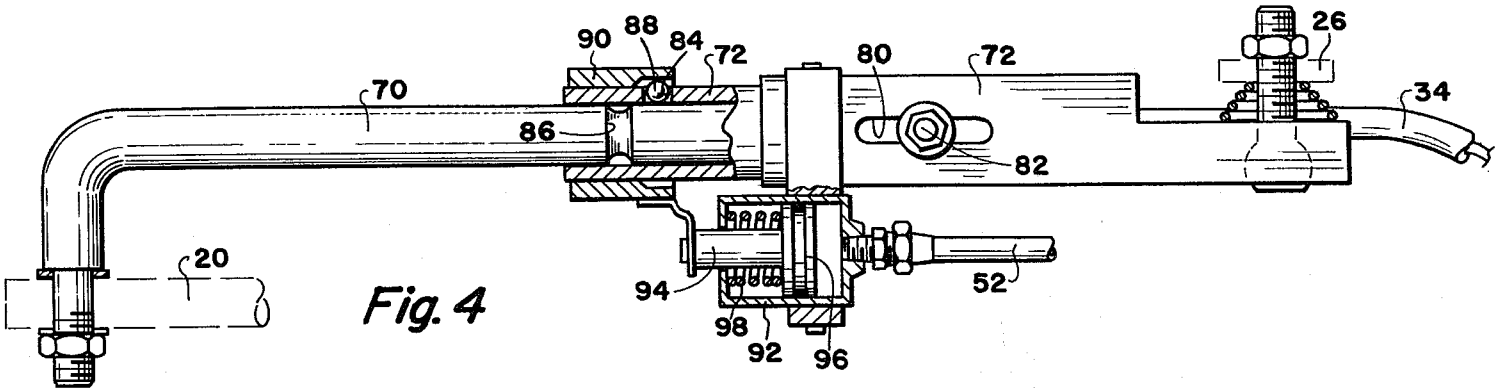

FIG. 4 is an elevational view, shown partly in cross-section, of an alternate embodiment of the invention including means for selectably locking a cylindrical member to a tubular member so that, in the locked condition, the steering of the boat is directly coupled to the motor assembly and in the unlocked condition the steering member has a limited amount of sliding movement before steering force is applied to the motor assembly.

Figure 5:
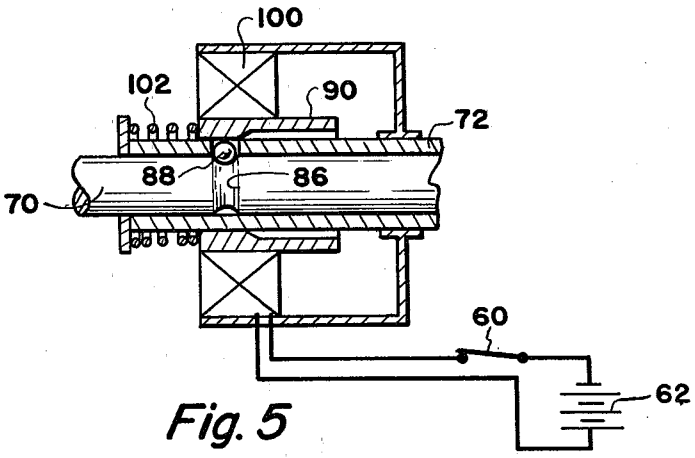

FIG. 5 is a fragmentary view of a portion of the embodiment of FIG. 4 showing the use of an electrical signal to lock or unlock the slip means.

DETAILED DESCRIPTION

Figure 1:
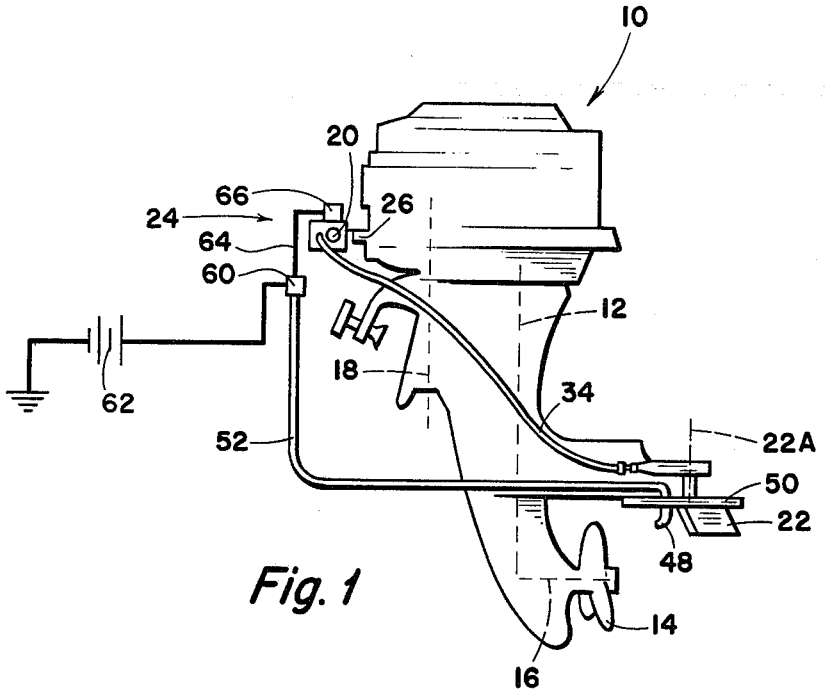
FIG. 1 is an elevational view showing a typical outboard motor and showing the power steering system of this invention as applied to it.

Referring to the drawings and first to FIG. 1, a preferred embodiment of the power steering system for an outboard motor or inboard/outboard power unit of this invention is provided. An outboard motor assembly is generally indicated by the numeral 10. In the illustrated embodiment the motor assembly 10 is an outboard motor in which the motor has a power shaft, the axis of which is indicated by the numeral 12, which drives a propeller 14 rotated about a horizontal shaft indicated in dotted outline by the numeral 16. A gearing means (not shown) transfers power from the vertical shaft 12 to horizontal shaft 16. The motor assembly 10 is mounted to the stern of a boat (not shown) and is arranged for pivotal rotation about a vertical axis 18, the axis 18 being forward of the propeller 14. The motor assembly 10 described to this point is of standard construction and, instead of being an outboard motor in which the motor in its entirety is external of the boat stern, the motor assembly could just as well be an inboard/outboard type in which the motor is internally of the boat with the stern drive mounted for pivotation about an axis 18 rearwardly of the boat stern. The function of the device, whether applied to an outboard motor or to an inboard/outboard drive unit, is exactly the same.

For small outboard motors steering may be accomplished by an arm (not shown) extending in a horizontal plane directly connected to the forward end of the motor. The operator merely steers the boat by rotating the motor 10 about the vertical axis 18. Most boat owners, however, prefer, and with larger size motors, it becomes mandatory, to use a boat steering system including a steering wheel (not shown) or, in some instances, sports fishermen prefer a steering stick (also not shown). In either event the steering system of the boat provides a remote means for actuating a steering member 20 in a horizontal plane adjacent the motor assembly 10 and forwardly of the vertical axis 18. The steering member 20 is thereby positioned in response to manually applied steering control; and since such types of boat steering systems are commonly and universally employed, the balance of the steering control is not illustrated, not being relative to the present invention.

In the typical manner of applying steering force to the boat, the steering member 20 is merely directly affixed to the motor assembly 10 so that when the operator applies steering force to a steering wheel or otherwise, to move the steering member 20, the motor assembly is simultaneously moved. As previously indicated, this system works fine except for larger powered boats in which the steering can become difficult and tiresome. To overcome this problem a power steering assist is utilized, employing a control rudder 22 which is mounted to the motor assembly 10. The control rudder 22 is mounted on a vertical axis aft of the propeller 14 and positioned in the slip stream of the propeller. A rudder steering means generally indicated by the numeral 24 extends from the control rudder 22 to the steering member 20 so that when the steering member 20 is laterally displaced, the control rudder 22 is rotated about its vertical axis 22A.

Figure 2:
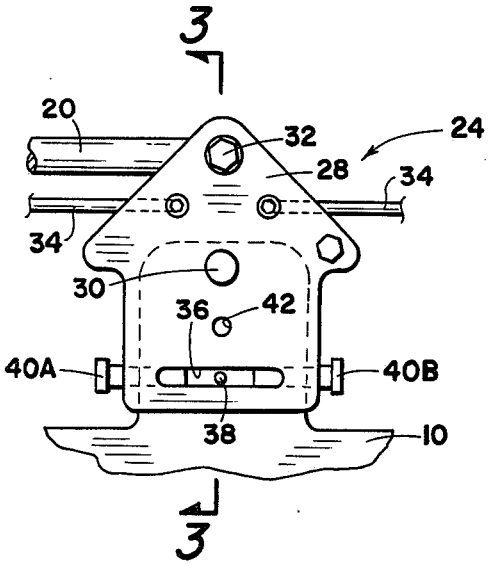
FIG. 2 is a plan view of one means of coupling the boat steering member to the motor assembly providing a slip arrangement therebetween and showing one means of providing a lockable slip.
Figure 3:
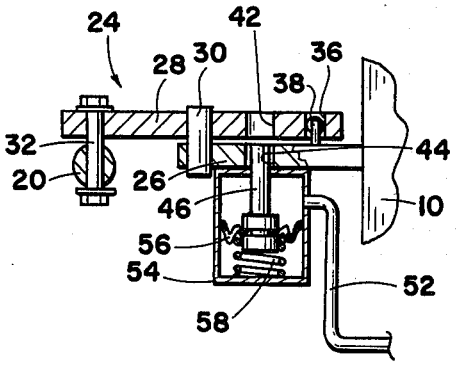
FIG. 3 is a cross-sectional view taken along the line 3—3 of FIG. 2.

In order to utilize the control rudder 22 to apply steering torque to the motor assembly 10, a slip arrangement must be provided so that when steering movement is imparted to the steering member 20 the control rudder 22 is first rotated about its vertical axis before steering force is applied directly from the steering member 20 the motor assembly. Reference may be had to U.S. Pat. No. 3,943,879 for a complete explanation of the means of operation of the control rudder 22 and control rudder steering means. One embodiment of a slip means is illustrated in FIGS. 2 and 3. The motor assembly 10 has extending from it a horizontal arm 26. A plate 28 is supported to arm 26 by means of a pivot pin 30. The boat steering member 20 is connected directly to the plate 28, such as by means of a bolt 32. Thus, when steering force is applied by the operator, such as by rotation of a steering wheel, steering member 20 applies steering force directly to plate 28, and since the plate is provided about pin 30, the plate pivots. This pivoting action is applied by cables 34 to control rudder 22 to rotate it about its axis 22A. Thus, the steering force is first applied to control rudder 22. If the control rudder does not function to effect steering of the motor assembly 10, then the steering force must be applied directly to rotate the motor assembly. This is accomplished by allowing a preselected slip between plate 28 and arm 26 and thereafter, coupling the motion of the steering member 20 to arm 26. For this reason, the plate 28 has a slot 36 therein. A pin 38 is affixed to arm 26 and is received within the slot 36. Threadably received in each side of the plate 28 and in the vertical plane of slot 36 are opposed bolts 40A and 40B. When the end of one of the bolts 40A and 40B engage pin 38, steering force is then applied to the motor assembly. Thus, by adjusting bolts 40A and 40B, the amount of slip between the steering member 20 and the motor assembly 10 is regulated.

The description of the slip means of FIGS. 2 and 3, up to this point, is a known technique and is a common means of providing steering of control rudder 22. An important part of this invention is the provision of an arrangement wherein the plate 28 is automatically locked to arm 26 under conditions wherein the control rudder 22 is of little or no value or, in some instances, is detrimental to the steering of a boat. For this purpose, an opening 42 is provided in the plate 28 and, in like manner, an opening 44 is provided in the arm 26. The openings 42 and 44 are in alignment in one point of the pivotation of the plate relative to the arm. In order to lock the plate 28 to arm 26 a plunger 46 is employed, and the plunger 46 may be moved either hydraulically, electrically, or manually. FIG. 3 shows an embodiment wherein the plate 28 is either locked or unlocked relative to arm 26 by a hydraulic signal. Referring back to FIG. 1, a pitot tube 48 is positioned relative to the boat on which the device of this invention is employed, and in an illustrated and preferred arrangement, the pitot tube is affixed to the motor assembly 10. The typical motor assembly 10 usually includes an anti-cavitation plate 50 to which the control rudder 22 is pivotally supported. The pitot tube 48 is placed in the slip stream of the boat so that water impacts on the pitot tube. A conduit 52 extending from the pitot tube carries a hydraulic pressure signal proportional to the speed of movement of the boat through the water. This hydraulic pressure signal, as illustrated in FIG. 3, is applied to the interior of a cylindrical housing 54 and acts against a diaphragm 56 within the housing. The perimeter of the diaphragm is secured to the internal cylindrical walls of the housing 54 and the center of the diaphragm is affixed to plunger 46. A spring 58 normally urges the plunger 46 in the upper direction, that is, in the direction so that the plunger extends through openings 42 and 44, locking the plate 28 to arm 26. However, when the hydraulic force in conduit 52, which as previously indicated, is proportional to the speed of forward movement of the boat, is sufficient to overcome the tension of spring 48, plunger 46 is moved downward and plate 28 is then free to pivot, within preselected limits, relative to arm 26. Thus, the power steering assist provided by control rudder 22 is activated only when the boat is moving forward above a preselected speed. This means that when the boat is moving rearwardly, or at a slow forward speed, or if the control rudder 22 and pivot tube 48 are out of the water, then the steering system of the boat is coupled directly to the motor assembly 10, eliminating any slack in the steering system.

An alternate arrangement for providing locking and unlocking of the slip means afforded by plate 28 is also illustrated. FIG. 1 shows the conduit 52 connected to a hydraulically actuated switch 60 which is supplied with electrical energy from a voltage source 62 which may be such as the boat battery 62, one poll of the battery being grounded. When preselected level of hydraulic pressure exists in conduit 52, the switch 60 is closed, applying electrical energy to conductor 64 to an electrically actuated solenoid 66.

Figure 3A:
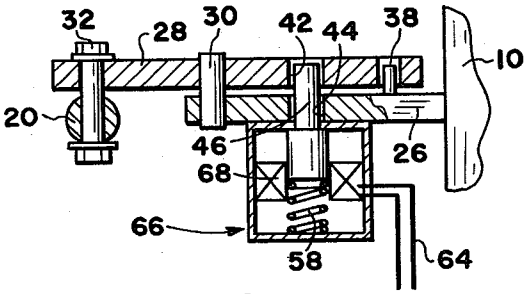
FIG. 3A is a cross-sectional view as shown in FIG. 3 but showing an alternate means of providing the locking arrangement between the motor and the steering member.

FIG. 3A shows one arrangement of how a solenoid may be employed to lock and unlock the slip means between the steering member and the motor assembly. Instead of a diaphragm, the plunger 46 is controlled by a solenoid coil 68. When the hydraulic actuated switch 60 is closed, electrical energy is supplied to pull the plunger 46 downwardly against the tension of spring 58 to thereby unlock the plate 28 from arm 26.

FIG. 1 shows the solenoid 66 above the arm 26 whereas in FIG. 3A it is below it and supported to the arm 26 but in either position it is seen that the function is the same, that is, when the plunger 46 extends between the openings 42 and 44, the slip means is locked, and when it is withdrawn, the slip means is unlocked and the power steering effect of control rudder 22 is utilized.

FIGS. 4 and 5 show an alternate arrangement by which the invention may be employed. In this arrangement the steering member 20 which is operated by the boat steering mechanism such as a steering wheel is connected to a cylindrical member 70. A slide tube or tubular member 72 slidably receives the cylindrical member 70 and is affixed to the motor assembly arm 26. The tubular member 72 has a slot 80 which slidably receives a bolt 82. Thus, slippage is provided between the cylindrical member 70 and tubular member 72 and certain slippage is provided between the steering member 20 before steering force is applied to the motor assembly arm 26. The cylindrical member 70 is affixed to cables 34 (only one of which is seen) so that when it is moved, force is applied to move the control rudder 22 as illustrated in FIG. 1. For a complete description of how the steering mechanism of FIG. 4 functions, reference may be had to U.S. patent application Ser. No. 055,615 entitled "Boat Steering Apparatus," filed July 9, 1979 now abandoned, continuation of Ser. No. 55,615 filed Jan. 19, 1981 and given Ser. No. 226,467.

To releasably lock the cylindrical member 70 to the tubular member 72, an opening 84 is formed in the tubular member. A groove 86 is formed in the peripheral surface of cylindrical member 70. Positioned in opening 84 is a ball 88 having a diameter greater than the thickness of the wall of the tubular member 72. A sleeve 90 is slidably positioned on the exterior of the tubular member 72, and when the portion thereof having an inside diameter only slightly greater than that of the external diameter of tubular member 72 is positioned over opening 84, ball 88 is forced downwardly into the groove 86.

Attached to the tubular member 72 is a cylindrical housing 92 having a plunger 94 extending therefrom which, within the housing, is connected to a piston 96. A spring 98 normally urges the piston and therefore the plunger rearwardly, and therefore normally urges the sleeve 90 in a position so that the reduced internal diameter is over opening 84. This means that the ball 88 must be in groove 86 and tubular member 72 is locked to the cylindrical member 70. However, when sufficient hydraulic pressure is applied from conduit 52, which extends to the pitot tube 48 as shown in FIG. 1, sufficient hydraulic pressure is applied against piston 96 to overcome the tension of spring 98 and move the sleeve 90 to the unlocked position illustrated.

FIG. 5 shows an alternate arrangement wherein the sleeve 90 is positioned by a solenoid coil 100. The spring 102 normally urges sleeve 90 to the closed position as illustrated. However, when solenoid coil 100 is energized, sleeve 90 is moved rearwardly, compressing spring 102 and unlocking the steering system. Hydraulically controlled switch 60 supplies energy from voltage source 62 in the same manner described reference to FIG. 3A, that is, when the hydraulic pressure in conduit 52 exceeds a preselected level, the hydraulic switch 60 (see FIG. 1) is actuated to closed position, thus unlocking the steering system and allowing the control feature afforded by control rudder 22 to function.

It can be seen that the piston 96 of FIG. 4 functions in the same manner as a diaphragm 56 of FIG. 3. This illustrates that a variety of embodiments may be employed to utilize a speed sensor such as the pitot tube 48 of FIG. 1, to control the locked or unlocked relationship of the boat steering system to the motor assembly.

While the use of a pitot tube as illustrated is a preferred arrangement, it can be seen that other types of speed detecting devices such as a lever extending from the motor assembly or from the boat itself, actuated upon by the force of water as the boat moves through the water, can be employed to provide an electrical signal when the speed is above a preselected level. Any device which will provide a signal when the boat speed is above a preselected level in the forward direction will function to achieve the results of this invention. The locking and unlocking can be done hydraulically or electrically as shown. The hydraulic switch 60 by which the pitot tube is utilized to provide an electrical signal, is not illustrated in detail since such devices are commonly employed in industry and are commercially available.

The invention has important safety advantages. It automatically utilizes the power steering advantages of a control rudder when a boat is moving forward above a preselected speed but removes the "sloppiness" between the boat steering and the control of the outboard motor or inboard/outboard power unit when the boat is moving slowly or when moving in the rearward direction. Further, if the speed sensor device is placed near the control rudder 22, such as the use of the pitot tube 48 as illustrated in FIG. 1, the slip arrangement between the boat steering and the motor assembly may be removed, that is, the steering locked to the motor assembly, even when the boat is moving at a high speed if the control rudder 22 is out of the water and therefore of no value. The arrangement for automatically locking the boat steering to the power unit during slow speeds and reverse, is much superior to any manually operated means, such as a remote control switch since the boat driver may forget to switch the boat steering as required for maximum safety of operation.

The invention has been described in the application in which steering force is applied mechanically, that is, by a cable. It can be seen that the concept of the invention can be used in which the steering force is applied hydraulically. In addition, an alternate embodiment includes the use of a switch mounted for control by the boat operator in parallel with solenoid 60 so the operator can lock or unlock the power steering system independent of the automatic action.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A power steering system for outboard motors or inboard/outboard power units, comprising:

a motor assembly having a power shaft and gears driving a propeller mounted on a horizontal rearward extending shaft, the motor assembly adapted for rotation about a hinge means having a generally vertical axis, the axis of rotation being on the side of the motor assembly opposite to that of the propeller, the hinge means being adapted to be secured to the stern of a boat;

at least one control rudder means mounted on a vertical axis on said motor assembly aft of said propeller and positioned in the slip stream of the propeller;

a steering assembly with said boat providing a steering member which is laterally displaced in a horizontal plane adjacent said motor assembly and forwardly of said vertical axis of rotation of said motor assembly, the steering member being positioned in response to manually applied steering control;

a control rudder steering means extending from said control rudder to said steering member whereby when said steering member is laterally displaced said control rudder is displaced about its axis whereby the force of the slip stream will apply torque to said motor assembly to rotate said motor assembly and thereby apply steering force to said motor assembly;

a lockable slip means between said steering member and said motor assembly wherein in the locked condition said steering member is secured to the motor assembly and in the unlocked condition a preselected amount of slip is provided between said steering member and said motor assembly;

means for detecting the speed of the boat forward movement;

means to actuate said lockable slip means responsive to said speed detecting means to lock said steering member to said motor assembly when the detected forward speed of the boat is below a preselected rate.

2. A power steering system according to claim 1 wherein said means for detecting the speed of the boat forward movement includes:

a pitot tube supported to the boat and positioned to receive the pressure of impact of the boat slip stream.

3. A power steering system according to claim 2 wherein said means to actuate said lockable slip means includes a diaphragm actuated plunger, the diaphragm being subjected to pressure detected by said pitot tube.

4. A power steering system according to claim 2 wherein said lockable slip means is moved between locked and unlocked positions by electrical means and including:

a hydraulically actuated switch means in electrical series with said lockable slip means, said pitot tube being connected to the hydraulically actuated switch.

5. A power steering system according to claim 2 in which said pitot tube is affixed to said motor assembly aft of said propeller.

6. A power steering system according to claim 1 wherein said lockable slip means includes:

a tubular member having a longitudinal slot therein;

a cylindrical member slidably received in said tubular member;

a pin affixed to said cylindrical member and slidably received in said slot in said tubular member providing limited movement of the cylindrical and tubular members, one of said members being attached to said motor assembly and the other to said steering member; and means to lockably secure said cylindrical member to said tubular member.

7. A power steering system according to claim 6 wherein said means to lockably secure said cylindrical member to said tubular member comprises:

the arrangement wherein said tubular member has an opening in the tubular wall thereof and wherein said cylindrical member has a notch in the cylindrical surface thereof, and including:

a ball carried in said opening in said tubular member of a diameter greater than the thickness of the wall of the tubular member;

a sleeve coaxially and slidably received on said tubular member, whereby when said notch in said cylindrical member is aligned with said opening in said tubular member said ball can partially enter said slot and said sleeve can be slidably advanced over said opening to retain said ball partially in said cylindrical member notch to thereby lock said tubular member to said cylindrical member; and means of slidably advancing said sleeve.

8. A power steering system according to claim 7 wherein said means of slidably advancing said sleeve includes electrical solenoid means.

9. A power steering system according to claim 7 wherein said means of slidably advancing said sleeve includes:

a pitot tube supported to the boat and positioned to receive the pressure of impact of the boat slip stream;

a hydraulically actuated means having a plunger extending therefrom connected to said sleeve; and a conduit connected to said hydraulically actuated means and to said pitot tube whereby said sleeve is moved to the unlocked position when the pressure of impact against said pitot tube exceeds a preselected level.

10. A power steering system according to claim 1 wherein said lockable slip means includes:

an arm affixed to and extending forwardly of said motor assembly;

a plate pivotally affixed to said arm;

means normally providing limited pivotal movement between said plate and said arm, said steering member being attached to said plate; and means of selectably locking said plate to said arm.

11. A power steering system according to claim 10 wherein said arm and said plate having an opening therein, said opening being in alignment in one orientation of said plate relative to said arm;

a reciprocal plunger which, in the extended position, extends through said openings; and means to extend or retract said plunger.

12. A power steering system according to claim 11 wherein said means to extend or retract said plunger includes electrical solenoid means.

13. A power steering system according to claim 11 wherein said means to extend or retract said plunger includes:

a tubular housing;

a diaphragm sealed at its periphery to the cylindrical wall of said housing, said plunger being affixed to said diaphragm;

a spring normally urging said plunger in the extended position wherein said plate is pivotally locked to said arm;

a pitot tube supported to the boat and positioned to receive the pressure of impact of the boat slip stream;

and a conduit connecting said pitot tube to the interior of said housing to apply hydraulic pressure against said diaphragm to move said plunger to the retracted position when the pressure of impact against said pitot tube exceeds a preselected level.

* * * * *